US006371083B1

(12) United States Patent
Rossi et al.

(10) Patent No.: US 6,371,083 B1
(45) Date of Patent: Apr. 16, 2002

(54) SELF-DAMPING MANIFOLD

(75) Inventors: Paul L. Rossi, Waterford; Kenneth O. Jahr, West Bloomfield; William T. Harvey, Brighton, all of MI (US); Shari F. Stottler, Honeoye Falls, NY (US); Kevin A. Grabowski, Brighton; Michael T. Streb, Livonia, both of MI (US)

(73) Assignee: Robert Bosch Corporation, Broadview, IL (US)

( * ) Notice: Subject to any disclaimer, the term of this patent is extended or adjusted under 35 U.S.C. 154(b) by 0 days.

(21) Appl. No.: 09/716,751

(22) Filed: Nov. 20, 2000

(51) Int. Cl.[7] ..... F02M 55/02
(52) U.S. Cl. ..... 123/456; 123/470; 138/26
(58) Field of Search ..... 123/456, 457, 123/470; 137/883; 138/26, 30, 118, 118.1

(56) References Cited

U.S. PATENT DOCUMENTS 3,227,147 A 1/1966 Gossiaux
4,570,600 A * 2/1986 Atkins et al. ..... 123/456 X
4,649,884 A 3/1987 Tuckey
4,651,781 A 3/1987 Kandelman
4,660,524 A 4/1987 Bertsch et al.
5,024,198 A 6/1991 Usui
5,197,436 A * 3/1993 Ozawa ..... 123/456
5,209,204 A * 5/1993 Bodenhausen et al. . 123/456 X
6,205,979 B1 * 3/2001 Sims, Jr. et al. ..... 123/456

* cited by examiner

*Primary Examiner*—Tony M. Argenbright
(74) *Attorney, Agent, or Firm*—Michael Best & Friedrich LLP

(57) ABSTRACT

A fuel manifold having a rigid base portion with a fuel injector pocket defined therein, a top wall portion, a first substantially flat thin-walled portion extending between the rigid base portion and the top wall portion and a second substantially flat thin-walled portion extending between the rigid base portion and the top wall portion. The base portion, the top wall portion and the first and second thin-walled portions are defined by a one-piece aluminum extrusion and together define a fuel cavity that extends into the base portion and communicates with the fuel injector pocket.

23 Claims, 2 Drawing Sheets

10
14
18
22
24
26
28
30
34
38
42
46
50
54
58
2
T
T'
W'
W
H

SELF-DAMPING MANIFOLD

FIELD OF THE INVENTION

The invention relates to fuel manifolds for the fuel system of an internal combustion engine.

BACKGROUND OF THE INVENTION

A fuel rail or manifold supplies fuel to a plurality of fuel injectors that inject the fuel into the corresponding inlet ports of the engine. Electromagnetic fuel injectors deliver fuel to the engine in metered pulses which are appropriately timed to the engine operation. The sequential energization of the fuel injectors induces within the fuel manifold pressure pulsations that create various problems including improper fuel distribution to the injectors, which can adversely affect tailpipe emissions and driveability, and fuel line hammering, which results in vibration and audible noise.

It is known to utilize a damper inside the fuel manifold to effectively minimize or dampen the pressure pulsations created by the fuel injectors. Using a damper increases the installation and assembly time of the fuel manifold, and thus increases the overall cost.

It is also known to utilize a fuel manifold that does not need a damper to reduce the pressure pulsations. An example of such a self-damping manifold is disclosed in U.S. Pat. No. 4,660,524 issued Apr. 28, 1987.

SUMMARY OF THE INVENTION

The fuel manifold of the present invention eliminates the need for a separate damper and provides greatly improved damping characteristics. The invention provides a simple and inexpensive one-piece extruded aluminum fuel manifold designed with optimum self-damping characteristics.

More specifically, the invention provides a fuel manifold having a rigid base portion with a fuel injector pocket defined therein, a top wall portion, a first substantially flat thin-walled portion extending between the rigid base portion and the top wall portion and a second substantially flat thin-walled portion extending between the rigid base portion and the top wall portion. The entire manifold is a one-piece aluminum extrusion and defines a fuel cavity that extends into the base portion and communicates with the fuel injector pocket.

The width of the fuel cavity in the base portion is preferably less than the width of the fuel cavity between the first and second thin-walled portions, and is preferably approximately one half of the width of the fuel cavity between the first and second thin-walled portions. Furthermore, the top wall portion and the first and second thin-walled portions define an upper portion that is preferably substantially rectangular in cross-section and has a width that is approximately one half the width of the base portion.

Other features and advantages of the invention will become apparent to those skilled in the art upon review of the following detailed description, claims, and drawings.

Figures 1, 2:
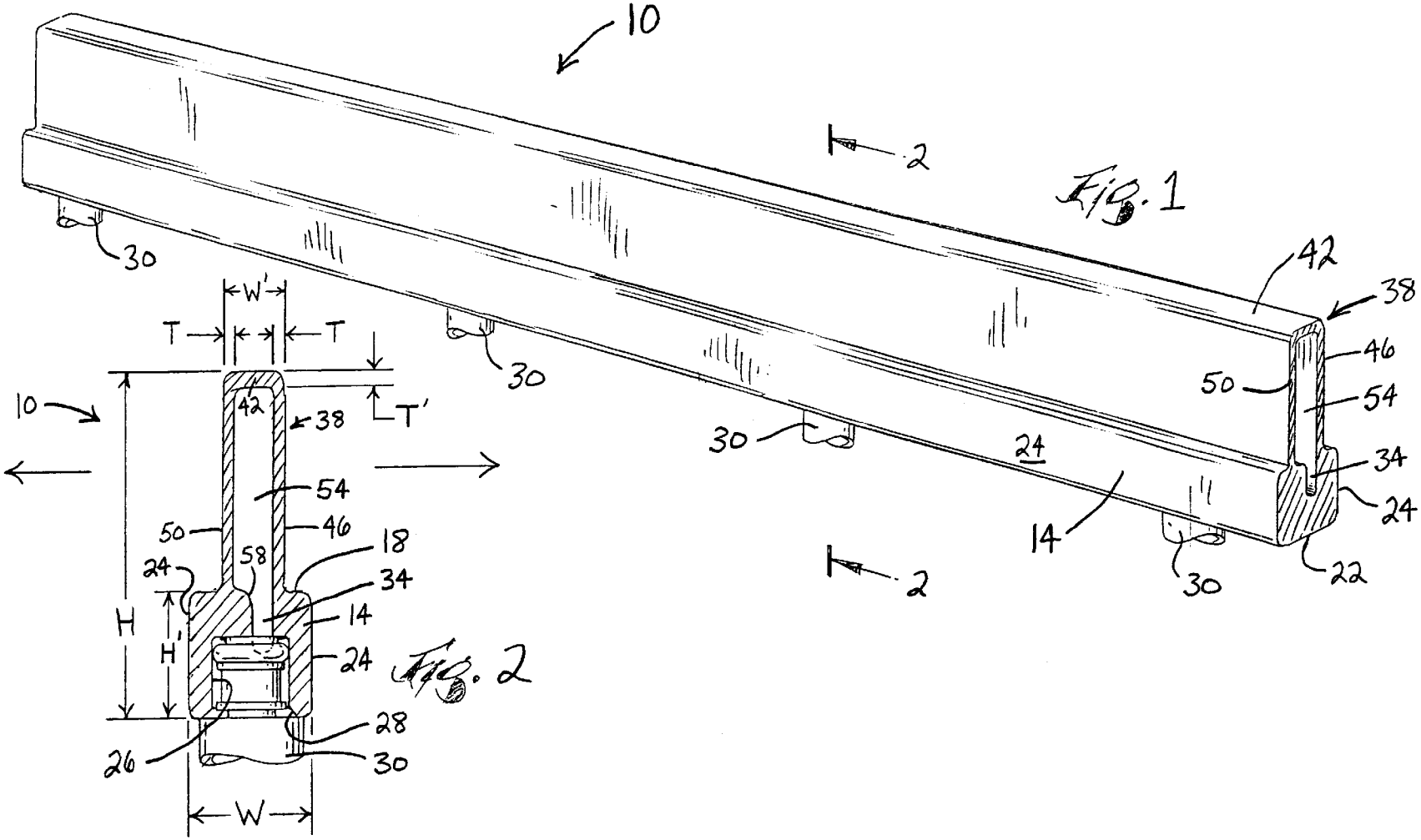
FIG. 1 is a perspective view of a fuel manifold embodying the invention.
FIG. 2 is a section view taken along line 2—2 in FIG. 1.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIGS. 1 and 2 illustrate a self-damping fuel manifold 10 embodying the present invention. The fuel manifold 10 is made from extruded aluminum or aluminum alloy, and includes a longitudinally extending rigid base portion 14. The base portion 14 has a top surface 18, a bottom surface 22, and opposing side surfaces 24. The base portion 14 is substantially square in cross-section. As used herein (including the claims), the terms "top," "bottom," "side," "upper," "height," and "width" are used only for convenience and do not indicate any particular orientation. The bottom surface 22 has therein a plurality of fuel injector pockets 26 (only one is shown) for receiving fuel injectors 30. The pockets 26 are preferably machined to be substantially smooth and cup-shaped, and to include a chamfered receiving portion 28 adjacent the bottom surface 22. The top surface 18 has therein a longitudinally extending groove 34 that communicates with the fuel injector pockets 26 as will be described below. The configuration of the pockets 26 can vary to suit the specific type of fuel injectors 30 being used. For example, the pockets 26 could be threaded for receiving threaded adapters (not shown) that retain and support the fuel injectors 30. As will be described in more detail below, it is also possible to machine the pockets 26 into one of the side surfaces 24 of the base portion 14.

The fuel manifold 10 also includes a thin-walled member or upper portion 38 having an interior defined by a top wall portion or connecting member 42 and first and second substantially flat thin-walled portions or arms 46 and 50, respectively. The thin-walled portions 46, 50 are preferably substantially parallel so that the thin-walled member 38 is substantially rectangular in cross-section. The thin-walled member 38 is connected to the top surface 18 over the groove 34 so that the groove 34 and the interior of the thin-walled member 38 define a fuel cavity 54.

The fuel manifold 10 is designed to optimize volumetric compliance and strength, which ultimately optimizes the damping characteristics of the manifold 10. The term "volumetric compliance" refers to the change in volume that occurs in the fuel cavity 54 as a function of pressure created by the fuel injector pulsations. The volumetric compliance of the manifold 10 is optimized by controlling design features such as the shape of the fuel cavity 54, the thicknesses of the top wall portion 42 and the thin-walled portions 46, 50, and the material used.

As best seen in FIG. 2, the fuel cavity 54 extends into the base portion 14 adjacent the thin-walled portion 46. In other words, the groove 34 is adjacent the thin-walled portion 46. Alternatively, the groove 34 could be adjacent the thinwalled portion 50. The width of the groove 34 is approximately one half the width of the portion of the fuel cavity 54 in the thin-walled member 38. A ridge 58 defines the transition between the wider fuel cavity portion in the thin-walled member 38 and the narrower fuel cavity portion in the base portion 14.

A portion of the fuel flowing longitudinally through the fuel cavity 54 fills the groove 34 and communicates with the fuel injectors 30. As the fuel injectors 30 are sequentially energized, fuel in the groove 34 flows into the fuel injectors 30 and is injected into the corresponding inlet ports (not shown). The injection of fuel by the fuel injectors 30 creates pressure pulsations in the fuel cavity 54 that should be damped.

The thin-walled member 38 is designed specifically to dampen the pressure pulsations. The thin-walled member 38, and more specifically the thin-walled portions 46, 50 are compliant, thereby allowing the volume of the fuel cavity 54 to change in response to the pressure pulsations. Each of the thin-walled portions 46, 50 is preferably rectangular in cross-section and has a thickness T of approximately 1.27 mm (0.050 inches). This configuration allows the thin-walled portions 46, 50 to flex outwardly (in the direction of the arrows in FIG. 2) under pressure and provide optimum damping characteristics.

The top wall portion 42 has a thickness T' that is greater than the thickness T of the thin-walled portions 46, 50. Preferably, the thickness T' is approximately two times the thickness T of the thin-walled portions 46, 50. This added thickness T' provides rigidity in the longitudinal direction and helps the top wall portion 42 support the ends of the thin-walled portions 46, 50 as they flex. Since the base portion 14 and the top wall portion 42 are thicker and more rigid than the thinwalled portions 46, 50, the pressure pulsations cause flexing substantially only in the thin-walled portions 46, 50.

For optimum damping, the base portion 14 has a height H' that is approximately one third of the height H of the manifold 10. The height of the thin-walled portions 46, 50 is therefore approximately two thirds of the height H of the manifold 10. It should also be noted that the base portion 14 has a width W that is approximately two times the width W' of the thin-walled member 38.

Tests run with the manifold 10 of the present invention have shown significant improvements in peak-to-peak pressure damping over conventional fuel manifolds. Conventional fuel manifolds typically experience peak-to-peak pressure readings ranging from 150 to 275 kPa at 500 RPM and dropping to 50 to 150 kPa between 2000 and 6000 RPM. The manifold 10 of the present invention experienced substantially constant peak-to-peak pressure readings of about 10 to 15 kPa regardless of engine RPM. As such, the fuel manifold 10 of the present invention provides significant advantages over the prior art manifolds in terms of improved fuel distribution, vibration reduction and noise reduction.

Since the fuel manifold 10 is extruded, it can be cut to any desired length and used in a variety of fuel systems. End caps (not shown) with the necessary fuel inlet and fuel outlet (if a return-type fuel system is used) are mounted on the ends of the manifold 10 prior to insertion into the fuel system (not shown). The end caps can be fastened to the manifold using any suitable fastening method, including welding. The one-piece construction of the manifold 10 (not including the end caps) increases the durability of the manifold 10 and provides a manifold having optimum damping characteristics that can be easily and inexpensively produced and assembled.

Figure 3:
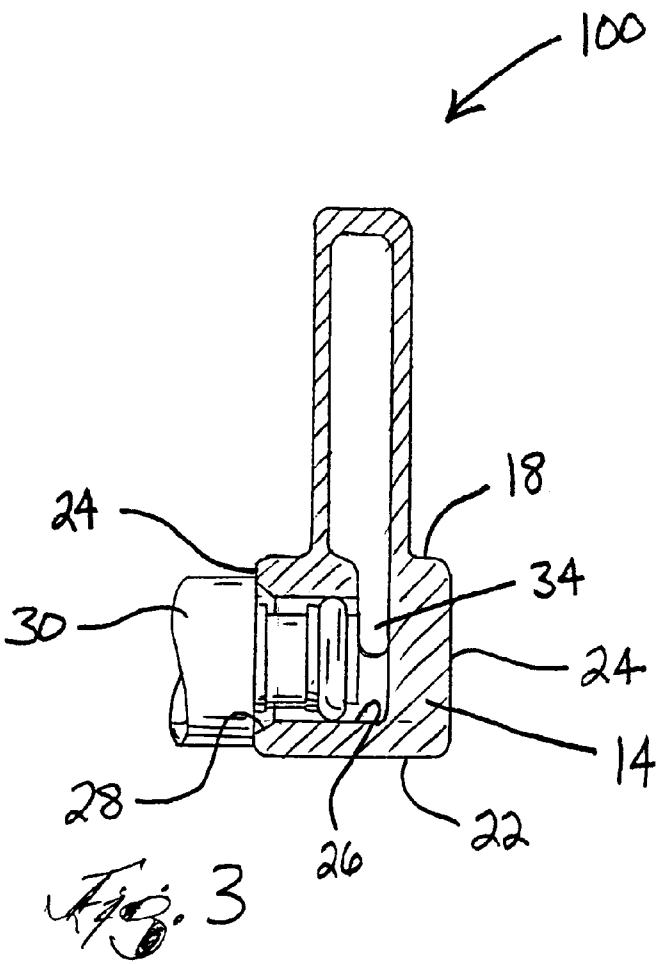
FIG. 3 is a section view similar to FIG. 2 showing an alternative placement of the fuel injector pocket.

FIG. 3 illustrates a fuel manifold 100 that is an alternative embodiment of the present invention. The fuel manifold 100 is substantially the same as the fuel manifold 10 with the exception of the location of the fuel injector pockets 26 (only one is shown). Like parts have been given like reference numerals. As seen in FIG. 3, the fuel injector pocket 26 is machined into one side surface 24 of the base portion 14, instead of into the bottom surface 22. The fuel injector pocket 26 is preferably machined into the side surface 24 furthest away from the longitudinally extending groove 34 (the left side in FIG. 3), such that the fuel inlet end of the fuel injector 30 properly communicates with the longitudinally extending groove 34.

The shape, size, and location of the groove 34 facilitates the alternative placements of the fuel injector pockets 26. Because the fuel manifolds 10 and 100 are originally the same extruded part that can accommodate fuel injector pockets 26 in either the bottom surface 22 (see FIGS. 1 and 2) or the side surface 24 (see FIG. 3), the fuel system designer has greater flexibility when packaging the fuel manifold on the engine.

Various features of the invention are set forth in the following claims.

What is claimed is:

1. A fuel manifold for a fuel-injected internal combustion engine, the fuel manifold comprising:

a rigid base portion having a fuel injector pocket defined therein;

a top wall portion;

a first substantially flat thin-walled portion extending between the rigid base portion and the top wall portion; and a second substantially flat thin-walled portion extending between the rigid base portion and the top wall portion; wherein the base portion, the top wall portion and the first and second thin-walled portions are defined by a one-piece aluminum extrusion and together define a fuel cavity that extends into the base portion and communicates with the fuel injector pocket.

2. The fuel manifold of claim 1, wherein the fuel cavity extends into the base portion adjacent the first thin-walled portion.

3. The fuel manifold of claim 1, wherein the second thin-walled portion extends substantially parallel to the first thin-walled portion.

4. The fuel manifold of claim 3, wherein the width of the fuel cavity in the base portion is less than the width of the fuel cavity between the first and second thin-walled portions.

5. The fuel manifold of claim 4, wherein the rigid base portion includes a bottom surface and opposing first and second side surfaces, the fuel cavity in the base portion being spaced further from the first side surface than the second side surface, and wherein the fuel injector pocket is formed in one of the bottom surface and the first side surface.

6. The fuel manifold of claim 4, wherein the width of the fuel cavity in the base portion is approximately one half of the width of the fuel cavity between the first and second thin-walled portions.

7. The fuel manifold of claim 3, wherein the top wall portion and the first and second thin-walled portions define an upper portion having a width and the base portion has a width greater than the width of the upper portion.

8. The fuel manifold of claim 7, wherein the width of the base portion is approximately twice as wide as the upper portion.

9. The fuel manifold of claim 1, wherein the base portion is substantially square in cross-section.

10. The fuel manifold of claim 1, wherein the top wall portion and the first and second thin-walled portions define an upper portion that is substantially rectangular in cross-section.

11. The fuel manifold of claim 1, wherein the base portion has a height that is approximately one third of the height of the fuel manifold.

12. The fuel manifold of claim 1, wherein the first and second thin-walled portions have substantially equal thicknesses, and wherein the thickness of the top wall portion is approximately twice the thickness of the thin-walled portions.

13. The fuel manifold of claim 1, wherein the first and second thin-walled portions have thicknesses of approximately 1.27 mm.

14. A fuel manifold for a fuel-injected internal combustion engine, the fuel manifold comprising:

a longitudinally extending rigid base portion having therein a fuel injector pocket and including a top surface having therein a longitudinally extending groove communicating with the fuel injector pocket; and a longitudinally extending thin-walled member which has an interior and which is connected to the top surface over the groove so that the groove and the interior of the thin-walled member define a fuel cavity;

wherein the base portion and thin-walled member are defined by a one-piece aluminum extrusion.

15. The fuel manifold of claim 14, wherein the width of the fuel cavity in the base portion is less than the width of the fuel cavity in the thin-walled member.

16. The fuel manifold of claim 15, wherein the rigid base portion includes a bottom surface and opposing first and second side surfaces, the fuel cavity in the base portion being spaced further from the first side surface than the second side surface, and wherein the fuel injector pocket is formed in one of the bottom surface and the first side surface.

17. The fuel manifold of claim 15, wherein the width of the fuel cavity in the base portion is approximately one half of the width of the fuel cavity in the thin-walled member.

18. The fuel manifold of claim 14, wherein the base portion is substantially square in cross-section.

19. The fuel manifold of claim 14, wherein the base portion has a height that is approximately one third of the height of the fuel manifold.

20. The fuel manifold of claim 14, wherein the thin-walled member has a width and the base portion has a width that is approximately twice the width of the thin-walled member.

21. The fuel manifold of claim 14, wherein the thin-walled member further includes first and second arms having substantially equal thicknesses, and a connecting portion extending between the arms and having a thickness approximately twice the thickness of the first and second arms.

22. The fuel manifold of claim 14, wherein the thin-walled member further includes first and second arms, and wherein the thickness of at least one of the first and second arms is approximately 1.27 mm.

23. A fuel manifold for a fuel-injected internal combustion engine, the fuel manifold having a height and comprising:

a rigid base portion having therein a plurality of fuel injector pockets and having a height that is approximately one third of the height of the fuel manifold;

a top wall portion;

a first substantially flat thin-walled portion extending between the rigid base portion and the top wall portion and having a thickness of approximately 1.27 mm; and a second substantially flat thin-walled portion substantially parallel to the first thin-walled portion and extending between the rigid base portion and the top wall portion and having a thickness of approximately 1.27 mm;

wherein the base portion, the top wall portion and the first and second thin-walled portions are defined by a one-piece aluminum extrusion and together define a fuel cavity that extends into the base portion adjacent the first thin-walled portion and communicates with the fuel injector pockets, the fuel cavity having a width between the first and second thin-walled portions and a width in the base portion that is approximately one half the width of the fuel cavity between the first and second thin-walled portions; and wherein the top wall portion and the first and second thin-walled portions define an upper portion having a width and the base portion has a width that is approximately twice the width of the upper portion.

* * * * *